US006677846B2

(12) United States Patent
Snider

(10) Patent No.: US 6,677,846 B2
(45) Date of Patent: Jan. 13, 2004

(54) MODULAR MAGNETIC TOOL SYSTEM

(75) Inventor: Greg S. Snider, Medina, OH (US)

(73) Assignee: Sulo Enterprises, Grafton, OH (US)

( * ) Notice: Subject to any disclaimer, the term of this patent is extended or adjusted under 35 U.S.C. 154(b) by 69 days.

(21) Appl. No.: 09/947,808

(22) Filed: Sep. 5, 2001

(65) Prior Publication Data

US 2003/0043005 A1 Mar. 6, 2003

(51) Int. Cl.[7] ..... H01F 7/02
(52) U.S. Cl. ..... 335/302; 294/65.5
(58) Field of Search ..... 335/302, 303, 335/304, 305, 306, 295; 209/215, 228

(56) References Cited

U.S. PATENT DOCUMENTS

| | | | | |
|---|---|---|---|---|
| 2,654,480 A | | 10/1953 | Stem | |
| 3,014,586 A | | 12/1961 | Ross | |
| 3,343,675 A | | 9/1967 | Budd | |
| 3,646,492 A | | 2/1972 | Westermann | |
| 4,407,038 A | | 10/1983 | Haase | |
| 5,285,904 A | | 2/1994 | Haase | |
| 5,395,148 A | * | 3/1995 | Jameson et al. | 294/65.5 |
| 5,624,146 A | | 4/1997 | De Los Reyes et al. | |
| 5,999,074 A | | 12/1999 | Coleman, Jr. et al. | |
| 6,076,873 A | | 6/2000 | Jung | |

FOREIGN PATENT DOCUMENTS

| | | | | |
|---|---|---|---|---|
| GB | 1500553 A | * | 2/1978 | H01F/7/02 |

* cited by examiner

*Primary Examiner*—Lincoln Donovan
*Assistant Examiner*—Bernard Rojas
(74) *Attorney, Agent, or Firm*—Roetzel & Andress

(57) ABSTRACT

A modular magnetic tool system utilizes one or more magnet modules and attachable components to enable selective assembly of a wide variety of magnetic tools. Channels of the magnet modules are connectable in series and in parallel, either by integral connectors or attachable components which can be selectively attached to the magnet modules singularly, in series, or in parallel to form different types of magnetic tools with different functions for different applications.

28 Claims, 5 Drawing Sheets

MODULAR MAGNETIC TOOL SYSTEM

FIELD OF THE INVENTION

The present invention is in the general field of tools and magnetic devices, and in particular magnetic tools constructable from modular units and components.

BACKGROUND OF THE INVENTION

Magnetic sweeping devices are one type of magnetic tool for attracting ferrous and other magnetic objects, such as loose fasteners and metallic debris, that fall to the floor of a metal fabricating facility or construction site and create safety hazards. The performance requirements of a magnetic sweeping devices and tools vary with intended uses and work environments. Some applications may require a wide sweeper that can cover a larger area with each sweeping stroke or pass over a surface than is available with a conventional modular magnetic tool system. For areas with a large concentration of ferrous debris, such applications may require a greater magnetic attraction than is available with a conventional modular magnetic tool system. Thus, a conventional magnetic sweeping device may not satisfy the needs of every possible end-use application. Because most magnetic tools are designed for hand use, they are proportionally small and not efficient for cleaning large areas. Also, permanently attached ergonomic handles interfere with or prevent alternative attachment of only the magnet portion to a support structure or device, such as a towlift, delivery cart or moving machinery.

SUMMARY OF THE INVENTION

The present invention provides a modular magnetic tool system which is adaptable to many different installations and uses, and which can be expanded to provide increased magnetic attraction, and which further enables expansion by combination of modular magnetic units to build a tool with desired dimensions and features.

The modular magnetic tool system of the invention provides multiple magnet modules, each module having one or more magnets retained in a bracket assembly attachable to other magnet and peripheral modules. A securing arrangement is provided for joining together the magnet bracket assemblies in telescoping or tandem arrangement. The brackets may include a magnet module connector on an end of one or more of the magnet holders. This magnet module connector is received and retained within a receptacle on an end of another of the magnet holders, so as to form a telescoping arrangement. The brackets may further include one or more fixture attachment fittings for attaching fixtures to the brackets.

In accordance with one general object of the invention, there is provided a modular magnetic tool system having at least one magnet module, the magnet module having a channel formed by generally parallel flanges and a connecting web, the channel having an interior space dimensioned to receive at least one magnet, a cover plate positioned over the magnet in the channel and secured to the channel, a magnet module connector having a portion positioned at least partially within one end of the channel, and which projects from one end of the channel and dimensioned to fit within an end of a channel of another magnet module. A steel cover plate directs the magnetic flux of the magnet within the channel in a concentrated attraction plane or direction. The channel is preferably non-ferrous, such as extruded aluminum, to assist in directing the magnetic flux.

In accordance with another general object of the invention, there is provided a magnet module for use in a convertible magnetic tool system, the magnet module having a channel adapted to receive a magnet, the channel having a web and two parallel opposed flanges extending from the web whereby the channel covers three sides of a magnet in the channel, and a cover plate which extends between aligned edges of the channel flanges opposite the channel web, the cover plate being attached to the channel web by at least one fastener which extends between the cover plate and the web; a magnet module connector dimensioned to fit at least partially within an end of the channel and attached by a fastener to the cover plate or web, a portion of the magnet module connector extending from an end of the channel and configured for insertion into the channel of another magnet module, or for attachment of a component.

Other advantages and objects of the invention are the ability to assemble large magnetic sweeper units from modules of a manageable size, e.g. 12 inches in length, which can be conveniently packaged and shipped by a common parcel carrier, rather than by commercial shipping. The modular components are also more manageable for retail packaging, display and sale in the typical retail store merchandising environment.

These and other objects of the invention are herein described in detail with reference to the accompanying Figures.

DETAILED DESCRIPTION OF THE PREFERRED AND ALTERNATE EMBODIMENTS OF THE INVENTION

Figures 1, 2:
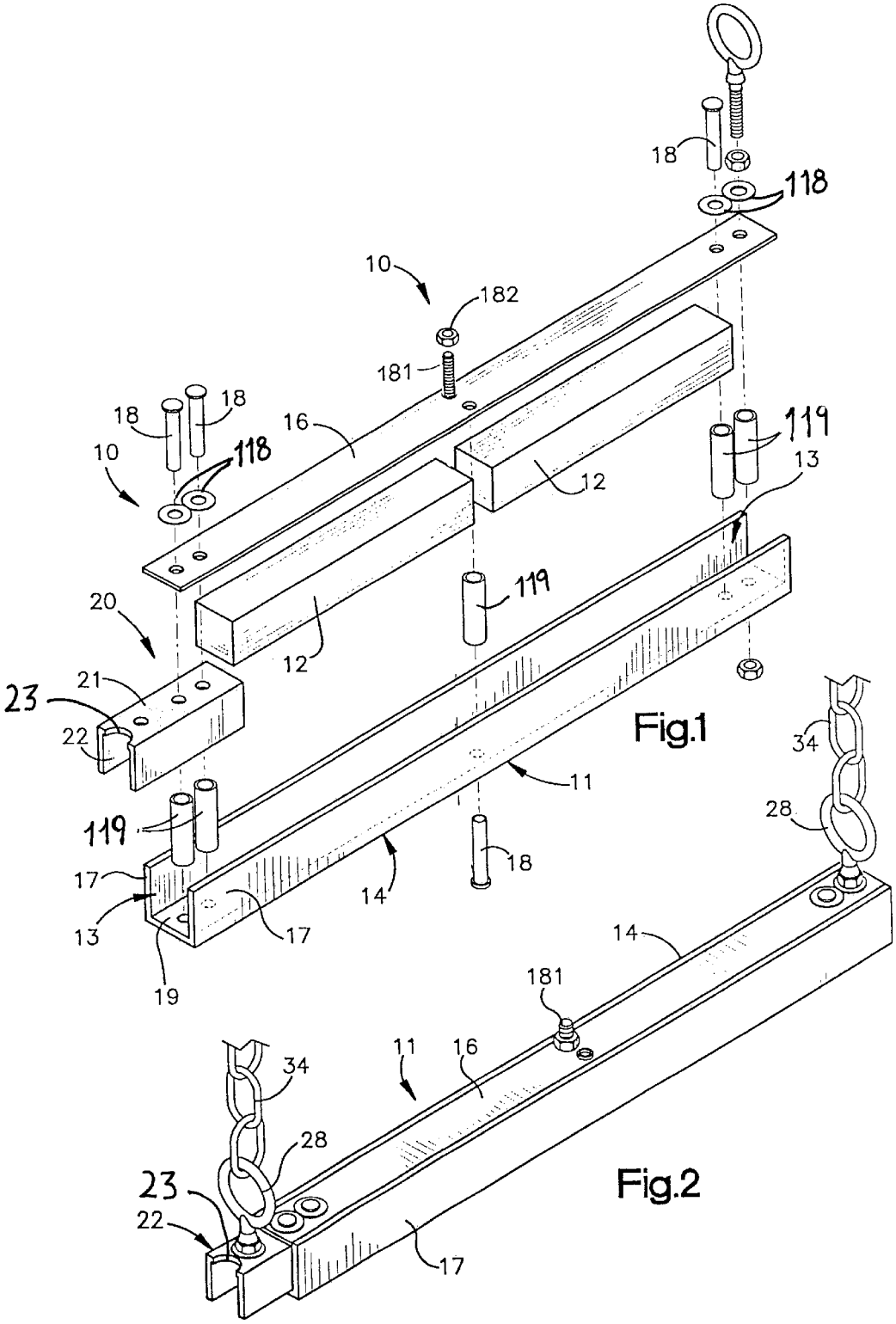
FIG. 1 is a perspective exploded view of a bracket and magnet assembly of a modular magnetic tool system of the invention.
FIG. 2 is a perspective view of a modular magnetic tool system of the invention.

As shown in FIG. 1, a modular magnetic tool system, indicated generally at 10, includes one or more magnet modules 11, which are combinable in different arrangements, and to which different types of components are attachable to provide a wide variety of magnetic tools. Each magnet module 11 has at least one magnet 12, for example in a bar form having a generally rectangular cross-section, which fits within a magnet housing, which in one embodiment may be in the form of a generally U-shaped channel 14 dimensioned to receive and retain the magnet 12 within the channel. As shown, multiple magnets 12 may be included within the channel, in part to avoid having to form holes through the magnets for fasteners, as further described. The channel 14 is formed by parallel opposed flanges 17 which extend in a common direction from a web 19, the channel width being sufficient to receive the magnet cross-section. One surface of the rectangular cross-section of the magnet faces an open side 13 of the channel 14, which is then covered by cover plate 16, thereby encapsulating the magnet 12. The channel 14 is preferably fabricated out of aluminum, such as an aluminum extrusion, to minimize weight of the module 11 and to not interfere with the magnetic lines of flux and polarity of the magnet(s) 12 therein. The cover plate 16, being opposite the channel web 19 and generally aligned with the desired flux direction, is preferably made of steel. The assembly of the magnet 12, channel 14, and cover plate 16 is fastened together by one or more fasteners 18 which between the cover plate 16 and web 19. Fasteners 18 can be rivets, bolts or threaded fasteners, or adhesive. Preferably, the fasteners 18 do not pass through the magnet 12, because the magnetized material is easily fractured. Additional fasteners 18 can be used along the length of the assembly, by using a series of separate magnets in the channel 14 which fit between the fasteners. The fasteners 18 can be arranged side-by-side along the length of the cover plate 16 (as shown at the ends of the cover plate) or side-by-side across the width of the cover plate (as shown at the middle of the cover plate). A bolt or threaded stud 181 and corresponding nut 182 may be used in place of a rivet type fastener in the middle of the module 11, and the end of bolt 181 may project beyond cover plate 16 (as shown in FIG. 2) for attachment of other components as later described. Washers 118 are preferably used about the heads of rivets 18 to strengthen the connection and to provide an indexing structure for attachment of components, as further described. The fasteners 18, 181 and the like are by themselves regarded as components which are attached to the magnet housing or channel/cover plate assembly.

Figure 3:
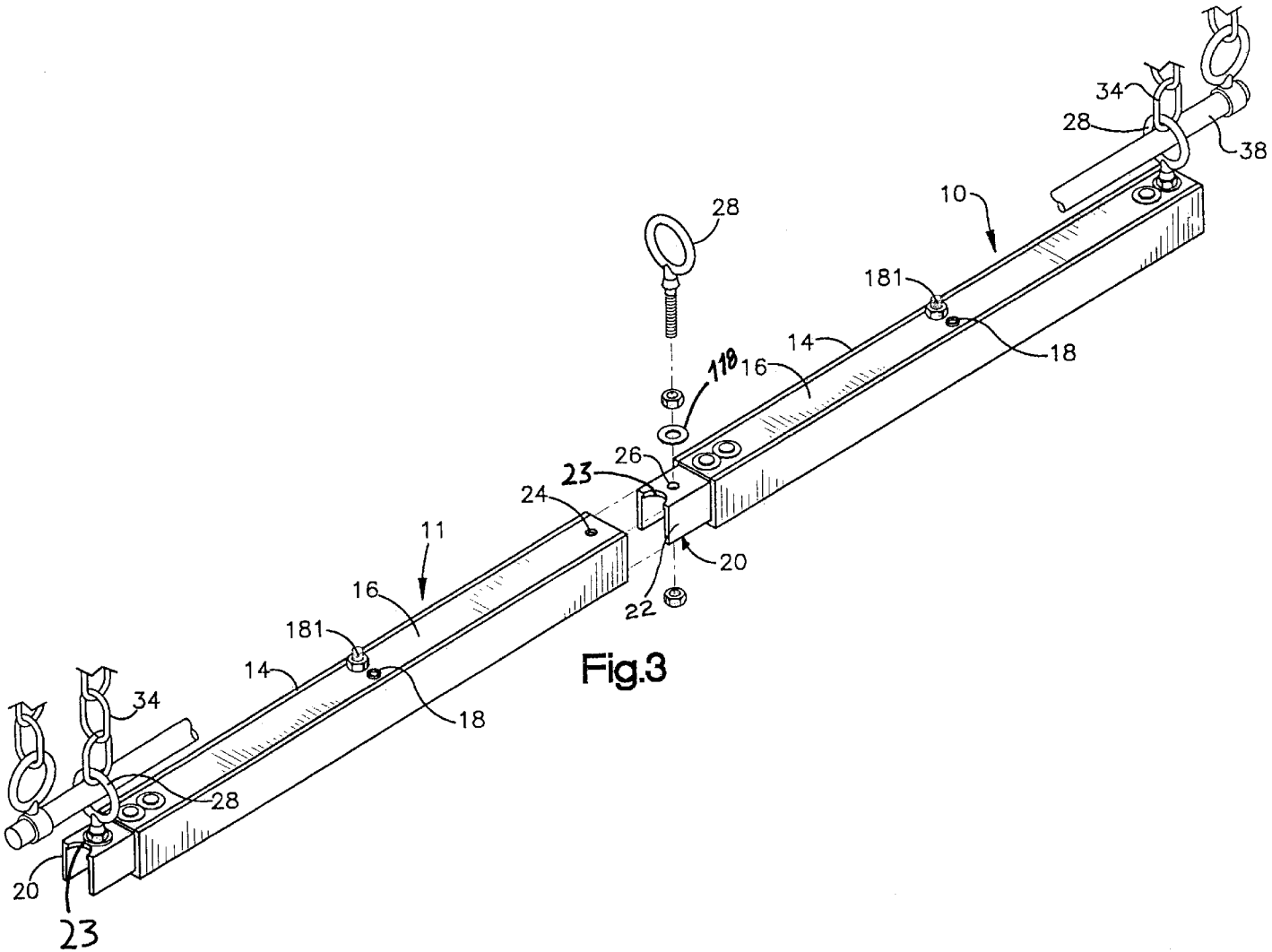
FIG. 3 is a perspective view of a modular magnetic tool assembly of the invention.

As further shown in FIGS. 2 and 3, each magnet module 11 of the modular magnetic tool system also includes a serial attachment piece for connecting one or more magnetic modules 10 in series. A channel connector 20 (also referred to as a "magnet module connector" and as one type of "component") is configured to fit within and project from an end of channel 14. Connector 20 is preferably in the form of a generally U-shaped channel having a width which fits inside the opposed flanges 17 of channel 14. For example, a web 21 of channel connector 20 is placed in abutment with the cover plate 16. A fastener 18 extends through the cover plate 16, web 21 and web 19 to secure a telescoping segment of magnet module connector 20 to channel 14, so that a projection 22 extends out of an end of channel 14. The magnet 12 terminates short of an opposite end of channel 14, leaving an opening within channel 14 for connector 20 to form a multiple length magnet assembly. The projection 22 is inserted into the open end of channel 14 (i.e., an end of channel 14 not having a connector 20 engaged therewith) in a telescopic manner as depicted in FIG. 3, thereby creating a serial connection of two or more magnet modules 11. A bushing 119, preferably a plastic/polymeric cylindrical piece, is provided about the shaft of fastener 18, with the ends of the cylinder providing a contact surface with the interior surfaces of the cover plate 16 and web 19. The outer diameter of the bushing 119 fits within an indentation 23 in the projection 22 to tightly register the channel connector 20 against the fastener. The magnet module connector 20 can be retained by a friction fit, or by a biasing tab or other type of fastening or securing arrangement. The magnet module connector 20 and the corresponding channel end may include respective bores 24, 26 for permitting securement with a fastener 18 or bolt 181. The bores 24, 26 can be threaded to receive fasteners such as a set screw or bolt, or can be oversized to permit through-fitting of a bolt which is secured with a nut at the opposite end. As further shown in FIG. 3, eyehooks 28 can be installed through the magnet housing (cover plate 16 and channel 14) to permit the assembly to be suspended, e.g. by a chain 34 from a moving apparatus or other device for performing a magnetic sweeping operation. For extended assemblies in series, i.e. multiple magnet modules 11 attached end-to-end, a reinforcing bar 38 can be employed to support the weight of the magnet module assembly, by threaded the bar 38 through eyehooks 28, and supporting the ends of the bar by separate means or by attachment to another supporting structure, such as the carriage of a vehicle. For suspension of parallel magnet module assemblies as shown in FIG. 5, a reinforcing bar 38 can be passed through U-bolts 38.

Figures 4, 5:
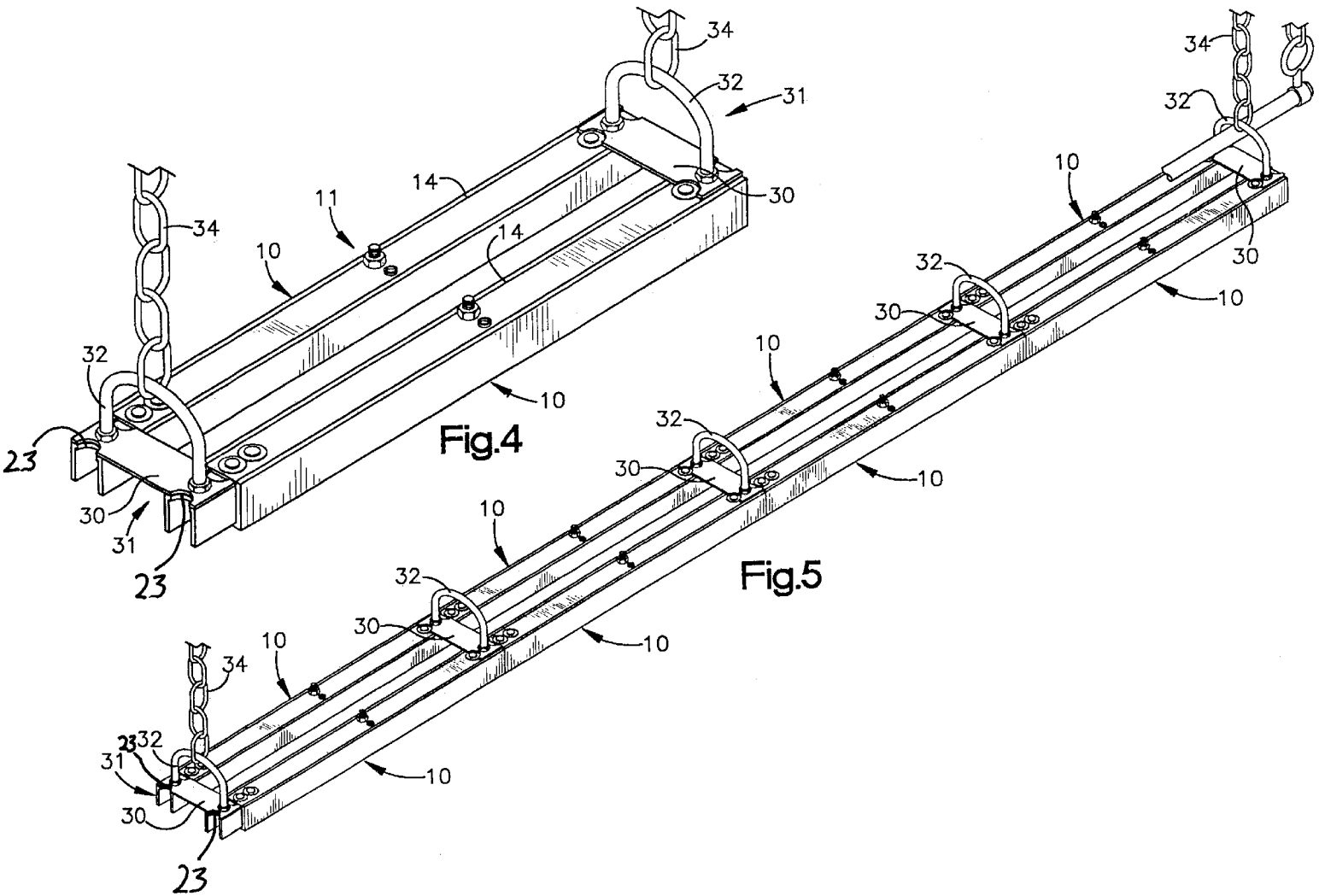
FIG. 4 is a perspective view of an alternate embodiment of the modular magnetic tool system of the invention.
FIG. 5 is a perspective view of an alternate embodiment of the modular magnetic tool system of the invention.

As shown in FIG. 4, the magnet modules 11 can be connected in parallel by use of laterally extending brackets 30, which serve to join two or more parallel arranged modules 11 at the ends of the channels 14. In the embodiment shown, the bracket 30 has ends 31 which fit over web 21 of the magnet module connector 22. Secured at the ends 31 of bracket 30 is a U-bolt 32 which extends over the bracket to the opposite end positioned over the magnet module connector 22 of the parallel adjacent module 11. With the brackets 30 attached at both ends of each of the parallel channels 14, a parallel arrangement of magnet modules 11 is formed. The U-bolts 32 may include threaded ends that engage the brackets 30 and the respective bores 24, 26 so as to hold the magnet modules 11 in a spaced, parallel tandem arrangement. The U-bolts 32 provide a means of attachment to other structures or devices, and also allow the assembly to be suspended, such as by chains 34 or other suitable suspension device. Brackets 30 can be made to various lengths in order to extend transversely across several magnet modules 11 arranged in parallel, for example three, four or more magnet modules connected in parallel, to create a magnetic platform with a wider operational area of magnetic flux.

As shown in FIG. 5, the parallel connecting pattern formed by use of the brackets 30 can be employed to create a continuous parallel array of magnet modules 11, e.g. having an overall length of several meters or greater, and width determined by the span of the U-bolts and length of brackets 30. The rigidity of the magnet module connector 22 when telescopically coupled with the adjoining channel 14 enables the structure to have considerable span, and to be suspended only at the ends, or at intermediate brackets 30. Larger modular assemblies of this type may be attached, for example, to the undercarriage of vehicles such as forklifts, lawn mowers, towmotors, utility vehicles or garbage or scrap handling machinery for ferrous object collection. In each of the described embodiments, the magnets 12 can be configured in any arrangement of poles, so as to have attracting or repelling poles in close or distant proximity, so as to create any desired magnetic field for any desired magnetic sweeping operation.

Figure 7:
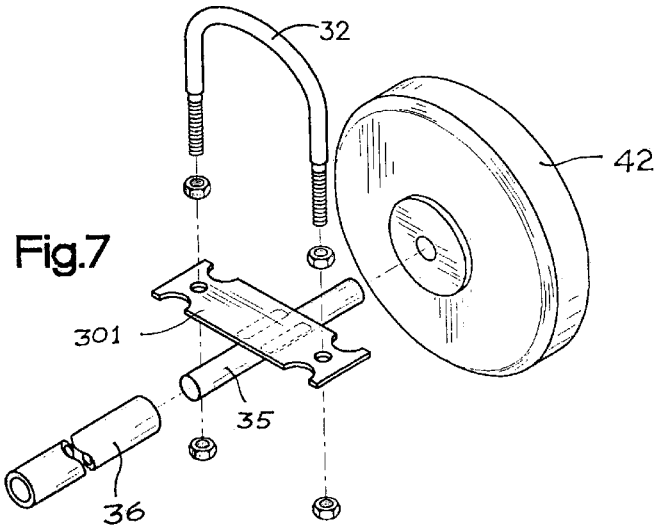
FIG. 7 is an isolated view of a bracket/axle assembly of the modular magnetic tool system of the invention.
Figure 6:
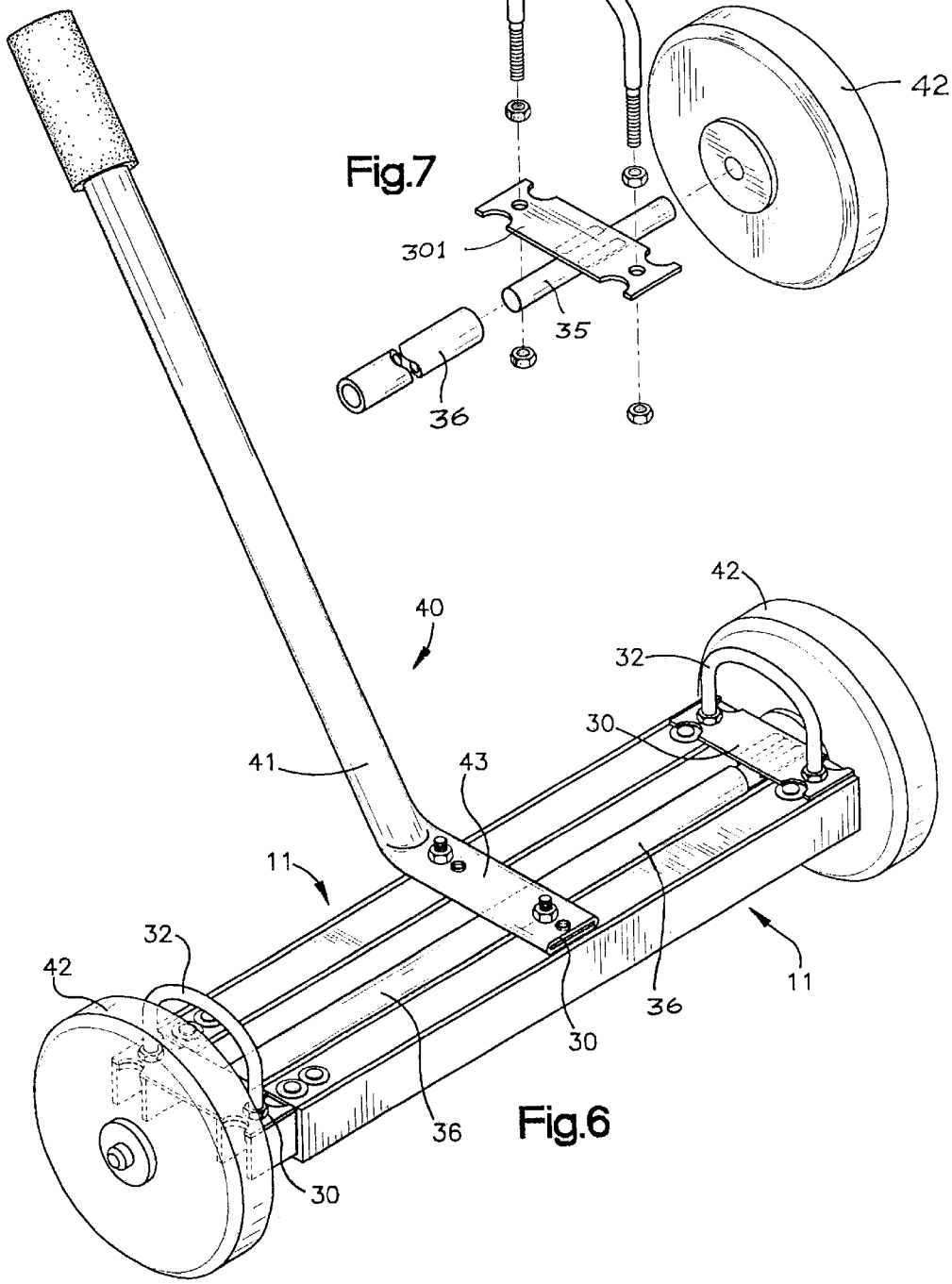
FIG. 6 is a perspective view of an alternate embodiment of the modular magnetic tool system of the invention, including a handle and wheel fixtures attached to the magnet brackets.

FIGS. 6 and 7 illustrate another aspect of the invention wherein additional components are added to the magnetic tool system, such as a handle and wheels, attached to single or parallel magnet modules 11 to form a particular type of tool, such as a rolling magnetic sweeper, indicated generally at 40. In this particular form, the sweeper 40 is built around a parallel assembly of magnet modules 11 secured together by brackets 30 as previously described. As shown in FIG. 6, a handle 41, having an attachment end 43, is attached either directly to the fasteners which extend through the magnet modules 11. An underlying reinforcing handle attachment bracket, similar to bracket 30, may be located on the opposite side of the magnet modules to also receive the ends of U-bolt 32 which are secured against the bracket by fasteners as shown.

Also shown in FIGS. 6 and 7, a modified wheel attachment bracket 301 includes a transversely attached axle 35, one half of which projects beyond the ends of the magnet modules 11 for rotational mounting of wheels 42. The axle 35 can be in the form of a rod of appropriate diameter which is welded to the planar surface of bracket 30. An axle rod 36 fits over the axle 35 to extend between brackets 30 along the length of a magnet module, to form an integrated axle wheel mount structure along the length of the magnet modules 11.

Figure 8:
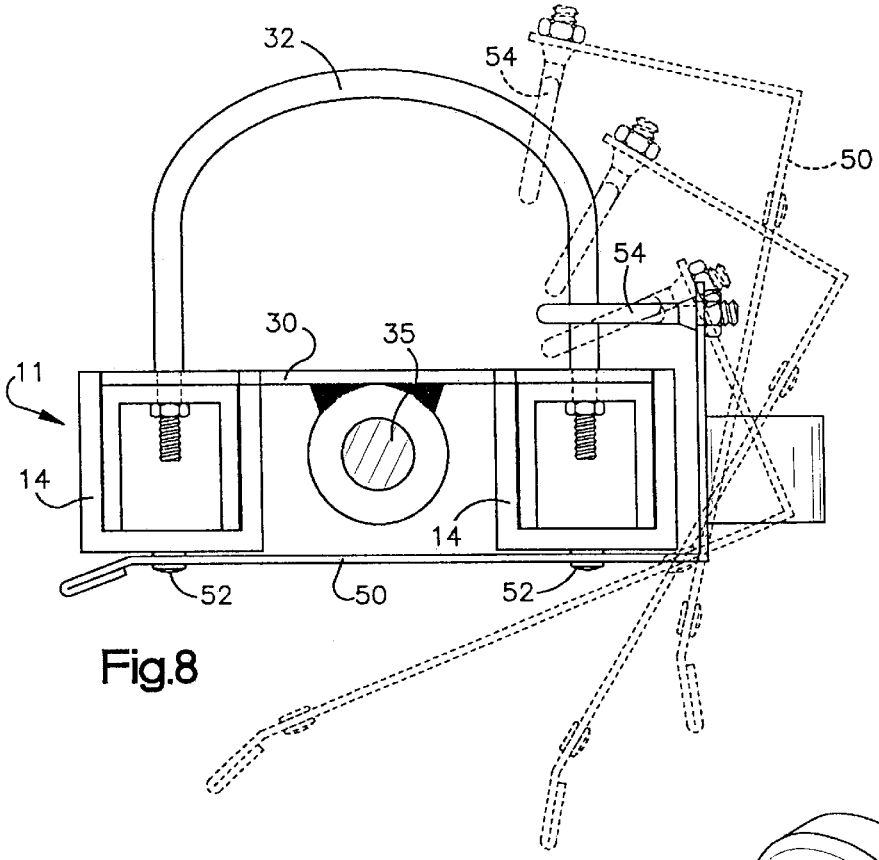
FIG. 8 is a side elevation and cutaway view of an alternate embodiment of the modular magnetic tool system of the invention.
Figure 9:
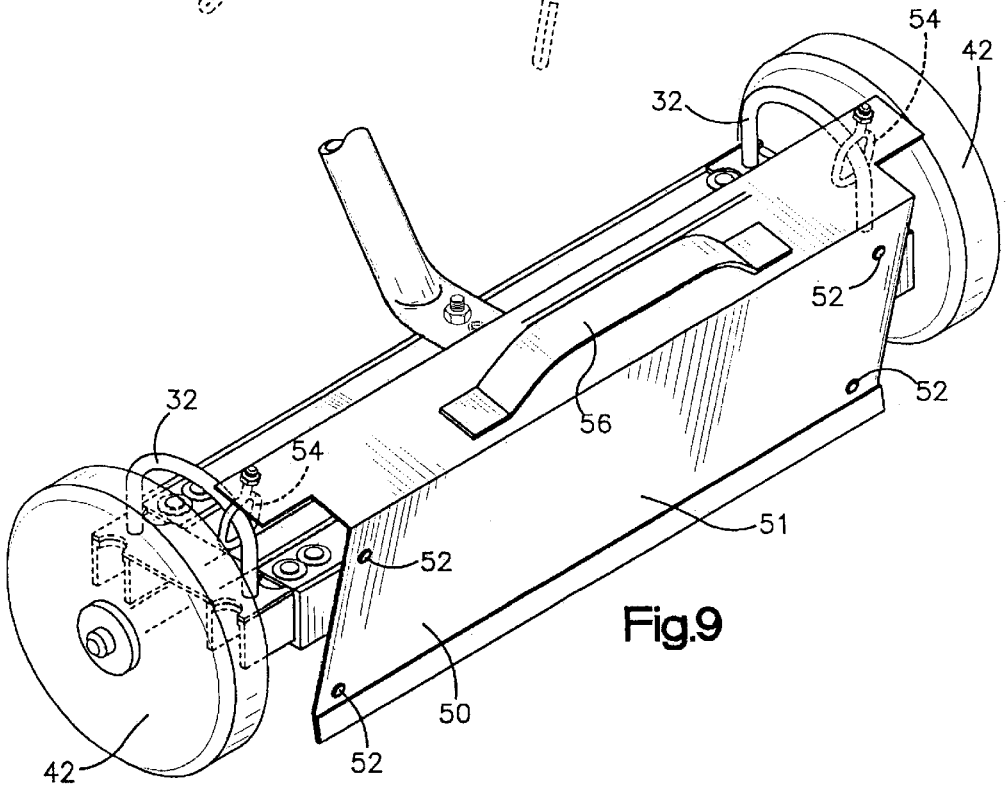
FIG. 9 is a perspective view of an alternate embodiment of the modular magnetic tool system of the invention.

FIGS. 8 and 9 illustrate a shield 50 which can be used in connection with various magnetic tools of the invention, such as the sweeper 40 previously described. In this particular form, the shield 50 has a main planar portion 51 dimensioned to cover primary attraction surfaces of the magnet modules 11, i.e. web 19 of channels 14. The shield 50 is preferably made of a non-ferrous material, which is of a minimized thickness which does not block the magnetic flux field emanating from the modules 11. Steel rivets 52 are placed through the shield in alignment with the channels 14 of the magnet modules 11 when the shield is in the covering position shown in FIG. 8. The shield 50 is mounted on oval-shaped eyebolts 54 which are anchored to the end U-bolts 32. The shield 50 is held in the covering position by attraction of rivets 52 by the magnets of the magnet modules 11. To clear the magnetic tool of attracted objects, the shield 50 is disengaged from the primary attracting surfaces of the magnet modules 11 by lifting handle 56, to bring the rivets 52 out of contact with the magnet modules 11 and allow the shield to be moved to a release position shown in FIG. 9. In this manner, a multitude of objects can be cleared from the magnetic tool in a single and swift operation, thereby eliminating the need to remove each individual ferrous piece from each of the magnet modules 11.

The invention thus provides a modular magnetic tool system which enables combinations of magnet modules and attachment components to create different types of magnetic tools for different applications. Various changes in the details, materials and arrangement and combination of parts or components of the invention may be made by those skilled in the art, but which are nonetheless within the modular magnet tool system concept of the invention, and within the scope of the patent claims.

What is claimed is:

1. A modular magnetic tool system having at least one magnet module, the magnet module having a channel formed by generally parallel flanges and a connecting web, the channel having an interior space dimensioned to receive at least one magnet, a cover plate positioned over the magnet in the channel and secured to the channel, a magnet module connector having a portion positioned at least partially within one end of the channel, and which projects from one end of the channel and dimensioned to fit within an end of a channel of another magnet module;

wherein the magnet module connector has a channel configuration with a portion of a web of the channel of the magnet module connector positioned against the cover plate.

2. The modular magnetic tool system of claim 1 wherein at least two magnet modules are connected in series.

3. The modular magnetic tool system of claim 1 wherein at least two magnet modules are connected in parallel.

4. The modular magnetic tool system of claim 1 wherein the channel of the magnet module is generally U-shaped.

5. The modular magnetic tool system of claim 1 wherein the channel is made of a non-magnetic material.

6. The modular magnetic tool system of claim 1 wherein the magnet module connector is secured to the magnet module channel by a fastener which passes through the cover plate.

7. The modular magnetic tool system of claim 1 wherein the magnet module connector further comprises an attachment fitting.

8. The modular magnetic tool system of claim 1 wherein an end of the magnet module connector within the channel abuts an end of a magnet in the channel.

9. A modular magnetic tool system having at least one magnet module, the magnet module having a channel formed by generally parallel flanges and a connecting web, the channel having an interior space dimensioned to receive at least one magnet, a cover plate positioned over the magnet in the channel and secured to the channel, a magnet module connector having a portion positioned at least partially within one end of the channel, and which projects from one end of the channel and dimensioned to fit within an end of a channel of another magnet module, wherein an open end of the channel for receiving a magnet module connector of a magnet module is formed by the channel and cover plate, and by an end of a magnet in the channel spaced from ends of the channel and cover plate.

10. The modular magnetic tool system of claim 9 having at least two magnet modules connected in series, wherein the magnet modules are connected in series by a magnet module connector of one magnet module positioned within an opening of a second magnet module, and a fastener connected to the magnet module connector and to the cover plate of the second magnet module.

11. The modular magnetic tool system of claim 1 comprising at least two magnets within the channel.

12. The modular magnetic tool system of claim 1 further comprising at least one fastener which extends from the cover plate to the channel at an end of a magnet within the channel, and a bushing about a portion of a fastener proximate to a magnet in the channel.

13. The modular magnetic tool system of claim 1 further comprising at least one component attached to the channel.

14. The modular magnetic tool system of claim 1 further comprising at least one component attached to the magnet module connector.

15. The modular magnetic tool system of claim 1 further comprising at least one component attached to the channel and at least one component attached to a magnet module connector.

16. The modular magnetic tool system of claim 3 wherein the magnet modules are connected by a bracket which extends from one magnet module to a parallel magnet module.

17. The modular magnetic tool system of claim 16 further comprising at least one component attached to a bracket which extends between two magnet modules.

18. The modular magnetic tool system of claim 1 wherein the channel is made of a non-ferrous material, and the cover plate is made of a ferrous material.

19. The modular magnetic tool system of claim 9 further comprising at least one component attached to a bracket which extends between two magnet modules, wherein the two magnet modules are connected in parallel by the bracket which extends from one magnet module to a parallel magnet module.

20. The modular magnetic tool system of claim 9 comprising at least two magnets within the channel.

21. The modular magnetic tool system of claim 9 further comprising at least one component attached to the channel.

22. The modular magnetic tool system of claim 9 further comprising at least one component attached to the magnet module connector.

23. The modular magnetic tool system of claim 9 further comprising at least one component attached to the channel and at least one component attached to a magnet module connector.

24. The modular magnetic tool system of claim 9 wherein the magnet module connector is secured to the magnet module channel by a fastener which passes through the cover plate.

25. The modular magnetic tool system of claim 9 wherein the magnet module connector further comprises an attachment fitting.

26. The modular magnetic tool system of claim 9 wherein an end of the magnet module connector within the channel abuts an end of a magnet in the channel.

27. The modular magnetic tool system of claim 9 wherein the channel is made of a non-magnetic material.

28. The modular magnetic tool system of claim 12, having at least two magnet modules connected in series, wherein the magnet modules are connected in series by a magnet module connector of one magnet module positioned within an opening of a second magnet module, and a fastener connected to the magnet module connector and to the cover plate of the second magnet module.

* * * * *